US010689167B2

(12) United States Patent
Sakimura et al.

(10) Patent No.: US 10,689,167 B2
(45) Date of Patent: Jun. 23, 2020

(54) CONTAINER AND CAP

(71) Applicants: TOKYO LIGHT INDUSTRY CO., LTD., Tokyo (JP); KYORAKU CO., LTD., Kyoto (JP)

(72) Inventors: Takaaki Sakimura, Tokyo (JP); Masashi Sasaki, Tokyo (JP); Masashi Mizuochi, Tokyo (JP); Hajime Sasaki, Tokyo (JP); Satoshi Ichikawa, Tokyo (JP)

(73) Assignees: TOKYO LIGHT INDUSTRY CO., LTD., Tokyo (JP); KYORAKU CO., LTD., Kyoto (JP)

( * ) Notice: Subject to any disclaimer, the term of this patent is extended or adjusted under 35 U.S.C. 154(b) by 24 days.

(21) Appl. No.: 15/566,091

(22) PCT Filed: Mar. 25, 2016

(86) PCT No.: PCT/JP2016/059659
§ 371 (c)(1),
(2) Date: Oct. 12, 2017

(87) PCT Pub. No.: WO2016/167101
PCT Pub. Date: Oct. 20, 2016

(65) Prior Publication Data

US 2018/0111724 A1 Apr. 26, 2018

(30) Foreign Application Priority Data

Apr. 15, 2015 (JP) ..... 2015-083306

(51) Int. Cl.
*B65D 47/04* (2006.01)
*B65D 47/20* (2006.01)
(Continued)

(52) U.S. Cl.
CPC ..... *B65D 47/2031* (2013.01); *B65D 41/185* (2013.01); *B65D 47/08* (2013.01);
(Continued)

(58) Field of Classification Search
CPC ..... B05B 11/0027; B05B 11/0072; B05B 11/00444; B05B 11/0005; B05B 11/3023;
(Continued)

(56) References Cited

U.S. PATENT DOCUMENTS 3,223,269 A * 12/1965 Williams ..... B65D 41/0414 215/318
3,572,413 A * 3/1971 Livingstone ..... B65D 41/185 215/320

(Continued)

FOREIGN PATENT DOCUMENTS

CN 101535143 A 9/2009
CN 202967002 U 6/2013

(Continued)

OTHER PUBLICATIONS

Office Action dated Sep. 20, 2018 for the corresponding Chinese Patent Application No. 201680021658.8.

(Continued)

*Primary Examiner* — Gideon R Weinerth
(74) *Attorney, Agent, or Firm* — Rankin, Hill & Clark LLP

(57) ABSTRACT

In the container, when the cap is capped on the container opening portion, an inner wall surface of a cylindrical sub-fitting wall portion of the cap and an outer wall surface of a large diameter opening portion of the container opening portion closely contact each other, and an outer wall surface of a cylindrical main fitting wall portion of the cap and an inner wall surface of a small diameter opening portion of the container opening portion closely contact each other. In this (Continued)

way, pressing force that is applied to the outer wall surface of the cylindrical main fitting wall portion of the cap from the inner wall surface of the small diameter opening portion of the container opening portion is increased.

9 Claims, 5 Drawing Sheets

(51) Int. Cl.

| | |
|---|---|
| ***B65D 35/14*** | (2006.01) |
| ***B65D 41/18*** | (2006.01) |
| ***B65D 47/08*** | (2006.01) |
| ***B65D 85/72*** | (2006.01) |
| *B05B 11/00* | (2006.01) |

(52) U.S. Cl.
CPC ..... *B65D 47/0857* (2013.01); *B65D 47/2018* (2013.01); *B65D 85/72* (2013.01); *B05B 11/0072* (2013.01); *B65D 47/2081* (2013.01)

(58) Field of Classification Search
CPC ..... B65D 47/2031; B65D 47/08; B65D 47/0857; B65D 47/2018; B65D 47/2081; B65D 41/185; B65D 85/72; B65D 35/44; B65D 35/46; B65D 35/14; B65D 41/165; B65D 47/2075; B65D 47/2087; B65D 47/04; B65D 47/0838; B65D 47/0804; B65D 47/20; B65D 47/40; B65D 75/5872; B65D 75/5877
USPC .... 220/782, 792; 222/545, 92, 96, 554, 546, 222/562, 212, 213, 490, 525, 105, 386.5; 215/43, 260
See application file for complete search history.

(56) References Cited

U.S. PATENT DOCUMENTS

| | | | | |
|---|---|---|---|---|
| 3,805,994 | A * | 4/1974 | Cherry | B65D 43/0212 220/782 |
| RE28,521 | E * | 8/1975 | Hammes | B65D 43/0212 215/274 |
| 5,033,647 | A * | 7/1991 | Smith | B05B 11/0072 222/212 |
| 5,275,312 | A | 1/1994 | Labruzzo | |
| 5,964,362 | A * | 10/1999 | Sandor | B29C 49/58 215/344 |
| 6,145,707 | A * | 11/2000 | Baudin | B05B 11/0027 222/189.09 |
| 6,386,404 | B1 * | 5/2002 | Auer | B65D 35/20 222/212 |
| 6,467,653 | B1 * | 10/2002 | Hamamoto | A45D 19/02 222/105 |
| 6,581,803 | B1 * | 6/2003 | Yoshimoto | B65D 83/0055 222/105 |
| 6,840,405 | B2 * | 1/2005 | Schneider | B65D 35/12 222/546 |
| 7,703,621 | B2 * | 4/2010 | Evans | B65D 47/0842 220/254.3 |
| 7,743,952 | B2 * | 6/2010 | Auer | B65D 41/185 215/237 |
| 7,874,466 | B2 * | 1/2011 | McConville | B65D 47/2031 220/203.18 |
| 9,669,973 | B2 * | 6/2017 | Hoshino | B65D 83/0055 |
| 9,974,419 | B2 * | 5/2018 | Azelton | A47K 10/42 |
| 10,259,624 | B2 * | 4/2019 | Sakimura | B65D 47/20 |
| 2002/0005415 | A1 * | 1/2002 | De Laforcade | B65D 47/2075 222/212 |
| 2002/0043512 | A1 * | 4/2002 | Sandor | B65D 41/3409 215/43 |
| 2002/0108924 | A1 * | 8/2002 | White | B29C 49/0073 215/320 |
| 2003/0029890 | A1 * | 2/2003 | Olechowski | B65D 47/10 222/525 |
| 2003/0094467 | A1 * | 5/2003 | Dark | B65D 47/2081 222/484 |
| 2005/0040182 | A1 * | 2/2005 | Suzuki | B65D 47/2031 222/105 |
| 2005/0051508 | A1 * | 3/2005 | Hackmann | B65D 41/0414 215/343 |
| 2006/0249545 | A1 * | 11/2006 | Ramsey | B65D 47/2031 222/494 |
| 2008/0169262 | A1 * | 7/2008 | Ekkert | B65D 41/0414 215/250 |
| 2008/0237271 | A1 * | 10/2008 | Olechowski | B65D 47/2031 222/494 |
| 2009/0308834 | A1 | 12/2009 | Isogai | |
| 2013/0240564 | A1 | 9/2013 | Albaum | |
| 2014/0144938 | A1 * | 5/2014 | Kakuta | B65D 35/14 222/105 |
| 2014/0246430 | A1 * | 9/2014 | Fracasso | B65D 35/08 220/200 |
| 2014/0263443 | A1 * | 9/2014 | Furusawa | B65D 83/0055 222/105 |
| 2015/0001260 | A1 * | 1/2015 | Hoshino | B65D 47/40 222/481 |
| 2015/0353245 | A1 * | 12/2015 | Sakimura | B65D 47/20 222/545 |
| 2018/0086516 | A1 * | 3/2018 | Sakimura | B65D 47/2075 |
| 2018/0111724 | A1 * | 4/2018 | Sakimura | B65D 41/185 |
| 2018/0148234 | A1 * | 5/2018 | Knight | B65D 47/2031 |
| 2018/0257831 | A1 * | 9/2018 | Benoit-Gonin | B65D 55/024 |
| 2019/0023463 | A1 * | 1/2019 | Knight | B65D 47/2081 |
| 2019/0291930 | A1 * | 9/2019 | Sakimura | B65D 41/165 |

FOREIGN PATENT DOCUMENTS

| | | |
|---|---|---|
| GB | 2335624 A | 9/1999 |
| JP | 62-38831 | 3/1987 |
| JP | 04-21465 | 2/1992 |
| JP | 2009-179375 | 8/2009 |
| JP | 2014-125250 | 7/2014 |
| WO | 2012031120 A1 | 3/2012 |

OTHER PUBLICATIONS

Office Action dated Jun. 21, 2018 for the corresponding Korean Patent Application No. 10-2017-7032918.
Supplemental Partial European Search Report dated Nov. 2, 2018 for the corresponding European Patent Application No. 16779892.5.
International Search Report dated Jun. 7, 2016 filed in PCT/JP2016/059659.
Chinese Office Action dated Jan. 7, 2020 for the corresponding Chinese Patent Application No. 201680021658.8 and its English translation.
Meng Yougun et al., "Selected International Freight Transport Regulations", p. 743, China Commerce and Trade Press, First Edition, May 31, 2006, China; Cited in Chinese Office Aciton.

* cited by examiner (a)

(b)

(c)

(a)

(b)

CONTAINER AND CAP

TECHNICAL FIELD

The present invention relates to a container to a container opening portion of which a cap molded from synthetic resin is attached by capping and the like, and to the cap.

BACKGROUND ART

Generally, when a cap is attached to a container opening portion by capping, the container opening portion is capped in an annular space provided in the cap between a body portion and a fitting wall portion disposed on the inside of the body portion, whereby the cap is attached to the container opening portion (see Patent Document 1).

According to the related art, the annular space of the cap has a width in the radial direction that is slightly narrower than the thickness of the peripheral wall of the container opening portion. In this way, the cap is attached to the container opening portion by the mutual pressing force between the body portion and fitting wall portion and the container opening portion.

When the outer diameter of the container opening portion is substantially constant in a predetermined range in the axial direction, the related art has no problems. However, when the container opening portion is configured with a plurality of opening portions (step portions) with different outer diameters successively disposed in the axial direction, the related art results in a problem of sealing between the container opening portion and the cap.

CITATION LIST

Patent Literature

Patent Document 1: JP-A-2009-179375

SUMMARY OF INVENTION

Problems to be Solved by the Invention

As indicated above, when the container opening portion is configured with a plurality of opening portions (step portions) with different outer diameters, simply fitting the container opening portion in the annular space of the cap results in the problem of sealing between the cap and the container opening portion.

The present invention has been made in view of the above. An object of the present invention is to provide a container and a cap with which, even when the cap is attached by capping to a container opening portion configured with a plurality of opening portions (step portions) with different outer diameters, sealing between the cap and the container opening portion can be ensured.

Solutions to the Problems

As a means for achieving the object, the invention relating to a container set forth in claim 1 provides a container with a cap attached to a container opening portion thereof by capping, the container opening portion including a large diameter opening portion disposed at an upper end, and a small diameter opening portion disposed under the large diameter opening portion and having an outer diameter smaller than the large diameter opening portion. The cap includes an annular space which is provided between a body portion and a tubular main fitting wall portion disposed inside the body portion, and in which the container opening portion is fitted, and a tubular sub-fitting wall portion formed in the annular space. When the cap is capped on the container opening portion, an inner wall surface of the sub-fitting wall portion of the cap and an outer wall surface of the large diameter opening portion of the container opening portion closely contact each other, and an outer wall surface of the main fitting wall portion of the cap and an inner wall surface of the small diameter opening portion of the container opening portion closely contact each other.

In the invention set forth in claim 1, when the cap is capped on the container opening portion, the outer wall surface of the main fitting wall portion of the cap and the inner wall surface of the small diameter opening portion of the container opening portion closely contact each other, and also the inner wall surface of the sub-fitting wall portion of the cap and the outer wall surface of the large diameter opening portion of the container opening portion closely contact each other. In this way, the pressing force applied from the inner wall surface of the small diameter opening portion of the container opening portion to the outer wall surface of the main fitting wall portion of the cap is increased. Accordingly, the sealing between the outer wall surface of the main fitting wall portion of the cap and the inner wall surface of the small diameter opening portion of the container opening portion is improved.

The invention relating to a container set forth in claim 2 is the container according to claim 1, wherein the container opening portion includes an extended diameter opening portion which gradually extends in diameter continuously downward from the small diameter opening portion, and a maximum diameter opening portion extending downward in an axial direction continuously from the extended diameter opening portion, and having a diameter greater than a diameter of the large diameter opening portion. When the cap is capped on the container opening portion, a maximum diameter opening portion of the container opening portion becomes engaged by moving across a ridged locking portion provided on a lower inner wall surface of the body portion of the cap, and thereby causes the extended diameter opening portion to become elastically deformed by being pressed from below.

In the invention set forth in claim 2, when the cap is capped on the container opening portion, the maximum diameter opening portion of the container opening portion becomes engaged by moving across the ridged locking portion provided on the lower inner wall surface of the body portion of the cap, whereby the extended diameter opening portion is elastically deformed by being pressed from below. Accordingly, the pressing force applied from the inner wall surface of the small diameter opening portion of the container opening portion to the outer wall surface of the main fitting wall portion of the cap is further increased. Accordingly, the sealing between the outer wall surface of the main fitting wall portion of the cap and the inner wall surface of the small diameter opening portion of the container opening portion can be further improved.

The invention relating to a cap set forth in claim 3 provides a cap attached to a container opening portion by capping, the cap including an annular space which is disposed between a body portion and a tubular main fitting wall portion disposed inside the body portion, and in which the container opening portion is fitted; and a tubular sub-fitting wall portion which is formed in the annular space, and which an outer wall surface of an upper end of the container opening portion closely contacts.

In the invention set forth in claim 3, in the case where a width in the radial direction of the annular space between the body portion and the main fitting wall portion is increased in accordance with the shape of the container opening portion compared with related art, when the cap is capped on the container opening portion, the outer wall surface of the upper end of the container opening portion closely contacts the sub-fitting wall portion formed in the annular space of the cap. In this way, the pressing force from the inner wall surface of the container opening portion to the outer wall surface of the main fitting wall portion of the cap is increased. Accordingly, the sealing between the outer wall surface of the main fitting wall portion of the cap and the inner wall surface of the container opening portion can be improved.

The invention relating to a cap set forth in claim 4 provides the cap according to claim 3 including an annular wall portion which integrally extends from an inner wall surface of the main fitting wall portion toward a radial center and diagonally upward, and which includes an ejection hole in a radially central portion, and a check valve which is disposed over the annular wall portion and which is configured to open and close the ejection hole as a valve portion is detached from or seated on an annular valve seat around the ejection hole.

The invention relating to a cap set forth in claim 5 is the cap according to claim 4 including a close contact portion between an outer wall surface of the main fitting wall portion and an inner wall surface of the container opening portion. The close contact portion is positioned higher than a connecting portion between the main fitting wall portion and the annular wall portion.

In the invention according to claims 4 and 5, the annular wall portion extends toward the radial center and diagonally upward. Accordingly, when the container opening portion is inserted in the annular space between the body portion and the main fitting wall portion, inward elastic deformation of the main fitting wall portion is permitted compared with a configuration in which the annular wall portion extends in the horizontal direction. Accordingly, the container opening portion can be inserted into the annular space smoothly without resistance. After insertion, the outward recovery force of the main fitting wall portion is increased by the annular wall portion. Accordingly, the sealing between the outer wall surface of the main fitting wall portion of the cap and the inner wall surface of the container opening portion can be further improved.

Effects of the Invention

According to the present invention, there are provided a container and a cap such that, even when the cap is attached to a container opening portion configured with a plurality of opening portions (step portions) with different outer diameters by capping, the sealing between the cap and the container opening portion can be ensured.

BRIEF DESCRIPTION OF THE DRAWINGS

FIG. 3(*b*) is a cross sectional view of FIG. 3(*a*); and FIG. 3(*c*) is a bottom view.

FIG. 4(*b*) is a cross sectional view of FIG. 4(*a*); and FIG. 4(*c*) is a bottom view.

FIG. 5(*b*) is a cross sectional view of FIG. 5(*a*).

DESCRIPTION OF EMBODIMENTS

In the following, a mode for carrying out the present invention will be described in detail with reference to FIG. 1 to FIG. 5.

A container 1 according to an embodiment of the present invention includes a container body 1*a* and a cap 2. The cap 2 is attached to a container opening portion 3 of the container body 1*a* by capping.

Figure 1:
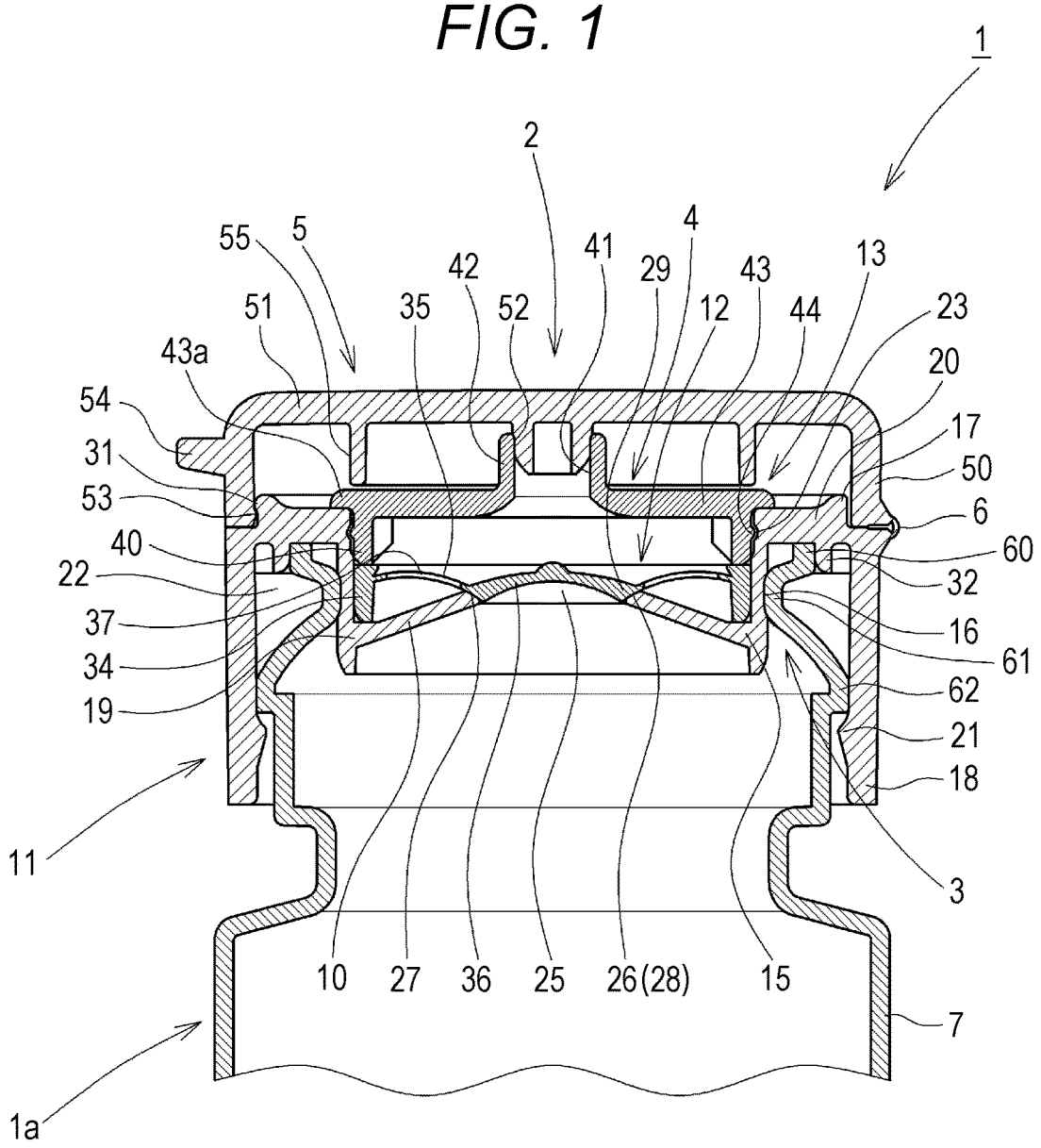
FIG. 1 is a cross sectional view of a container according to an embodiment of the present invention, with a cap attached to a container opening portion thereof.

As illustrated in FIG. 1, the container body 1*a* is an easily deformable member, such as a tubular container, that is filled inside with a liquid content, or a flowable content having viscosity. Examples of the content include soy sauce, ponzu sauce, olive oil, dressings, mayonnaise, ketchup, ton-katsu (pork cutlet) sauce, and mustard paste. The container body 1*a* is the type of container from which the content is ejected by applying an internal pressure by, e.g., squeezing a body portion 7 thereof. The container opening portion 3 is formed in a cylindrical shape. The container body 1*a* includes a double container (including a container referred to as a delamination container) comprising an outer container and an inner container. The inner container is internally filled with the content. The inner container has flexibility so that the inner container becomes shrunk and deformed as the content decreases. In order to retain a reduced volume shape of the inner container, the inner container is configured such that outer air can be suctioned between the outer container and the inner container.

Figure 2:
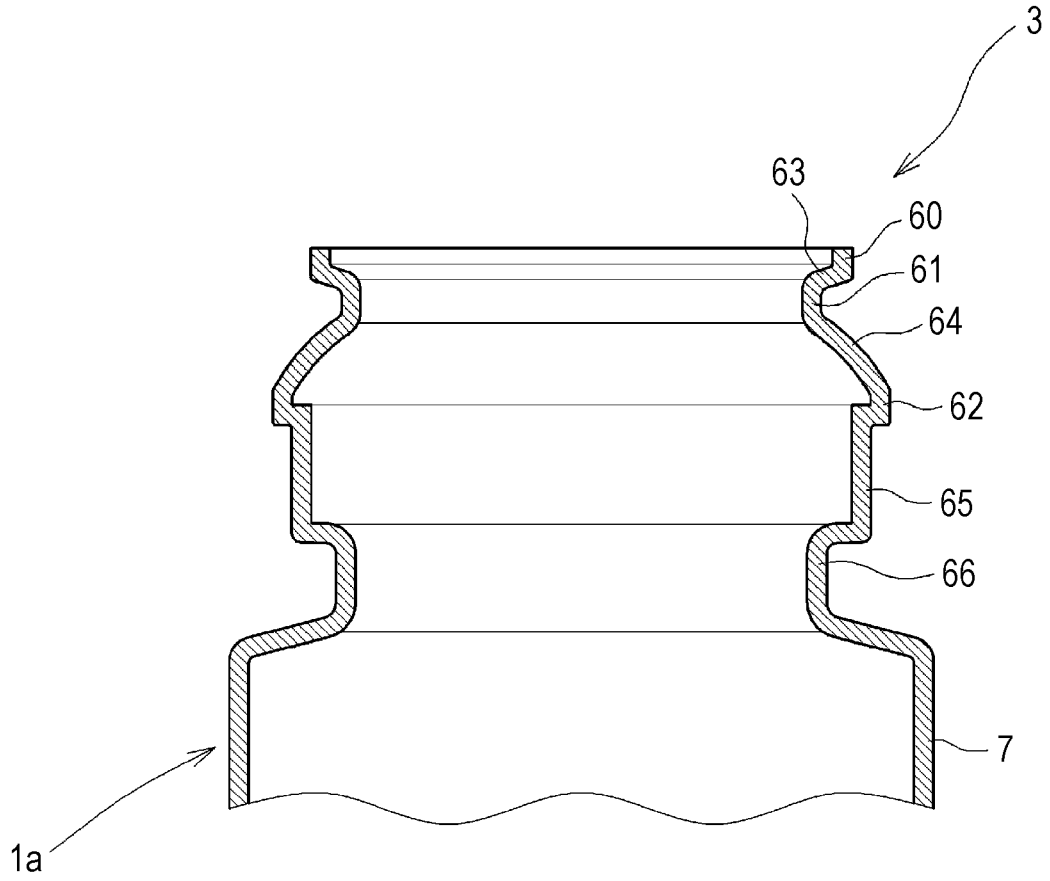
FIG. 2 is a cross sectional view of the container opening portion of FIG. 1.

As illustrated in FIG. 1 and FIG. 2, the container body 1*a* is constructed from the body portion 7, and the container opening portion 3 formed so as to be continuous with the body portion 7. To the container opening portion 3, the cap 2 is fitted by capping. The container opening portion 3 is formed in a cylindrical shape as a whole. The container opening portion 3 is formed so as to be continuous with the body portion 7 with substantially the same thickness. The container opening portion 3 is configured such that a plurality of opening portions (step portions) with different outer diameters is successively disposed along an axial direction. Specifically, the container opening portion 3 includes a large diameter opening portion 60, a small diameter opening portion 61, and a maximum diameter opening portion 62. The large diameter opening portion 60 is disposed at the upper end, and extends in the axial direction. The small diameter opening portion 61 is disposed under the large diameter opening portion 60, has an outer diameter smaller than the large diameter opening portion 60, and extends in the axial direction. The maximum diameter opening portion 62 is disposed under the small diameter opening portion 61, has an outer diameter greater than the large diameter opening portion 60, and extends in the axial direction. The large diameter opening portion 60 positioned at the upper end and the small diameter opening portion 61 are connected via a reduced diameter opening portion 63 which is elastically deformable. The reduced diameter opening portion 63 is gradually reduced in diameter continuously from the large diameter opening portion 60 downward. The small diameter opening portion 61 and the maximum diameter opening portion 62 are connected via an extended diameter opening portion 64 which is elastically deformable. The extended diameter opening portion 64 is gradually extended in diameter continuously from the small diameter opening portion 61 downward. Under the maximum diameter opening portion 62, a support opening portion 65 is continuously formed, the support opening portion having a diameter smaller than the maximum diameter opening portion 62 and greater than the large diameter opening portion 60 and extending in the axial direction. Between the support opening portion 65 and the body portion 7, a recessed opening portion 66 with substantially the same diameter as the small diameter opening portion 61 is formed. When the container opening portion 3 is capped with the cap 2, the outer peripheral area of the recessed opening portion 66 is held by a capping machine (not shown).

Figure 3:
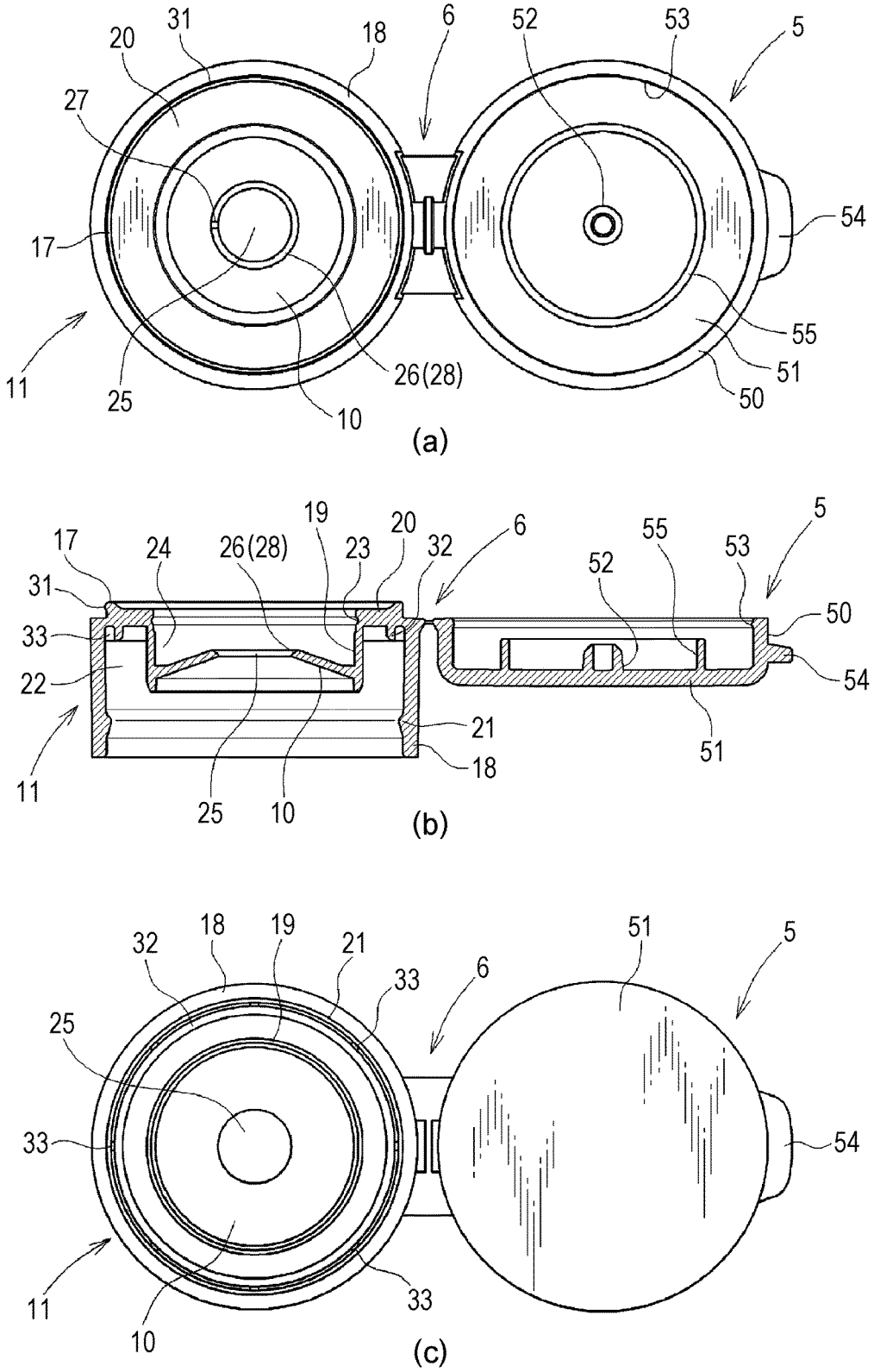
FIG. 3 is a plan view of a lid member and a main cap member including an annular wall portion, in the configuration of the cap of FIG. 1.

The cap 2 according to the embodiment of the present invention is configured such that, immediately after a user squeezes the body portion 7 of the container body 1*a* to apply an internal pressure to the container body 1*a* and uses an appropriate amount of the content, the inside of the container body 1*a* is hermetically sealed by a check valve 12 without the user operating the cap 2 manually. Specifically, the cap 2, as illustrated in FIG. 1, is configured from a cap body 4 having a content ejection hole 25, and a lid member 5. The lid member 5 is coupled, via a hinge 6, with a main cap member 11 constituting the cap body 4. The cap 2 is constructed by assembling three constituent members: the main cap member 11, which, as illustrated in FIG. 3, includes an annular wall portion 10 and to which the lid member 5 is coupled; the check valve 12, illustrated in FIG. 4; and an inner plug 13 illustrated in FIG. 5. The lid member 5 may not be coupled with the cap body 4 by the hinge 6, and may be configured as a separate member.

As illustrated in FIG. 1, the cap body 4 is configured from: the main cap member 11, with which the container opening portion 3 is capped and which has a cylindrical shape; the annular wall portion 10; the check valve 12; and the inner plug 13. The annular wall portion 10 extends integrally from an inner wall surface of a cylindrical main fitting wall portion 19 of the main cap member 11 toward the radial center and diagonally upward. The annular wall portion 10 has the ejection hole 25 at the radially central portion. The check valve 12 is disposed over the annular wall portion 10. The check valve 12 is configured to open and close the ejection hole 25 as a valve portion 36 is detached from or seated on an annular valve seat 26 around the ejection hole 25. The inner plug 13 is disposed over the check valve 12. The inner plug 13 communicates with the ejection hole 25, and includes an ejection passageway 41 for the content from the ejection hole 25. The check valve 12 is molded from a synthetic resin which is more elastic than a synthetic resin from which the main cap member 11 is molded. Specifically, the main cap member 11 including the lid member 12 is molded from polypropylene. The inner plug 13 is molded from polyethylene. The check valve 12 is molded from a polyethylene elastomer.

As illustrated in FIG. 1 and FIG. 3, the main cap member 11 is configured from a body portion 18, the cylindrical main fitting wall portion 19, and an annular horizontal wall portion 20. The cylindrical main fitting wall portion 19 is disposed concentrically on the inside of the body portion 18. The annular horizontal wall portion 20 connects the upper end of the body portion 18 and the upper end of the cylindrical main fitting wall portion 19. On a lower inner wall surface of the body portion 18, a ridged locking portion 21 is formed. Between the cylindrical main fitting wall portion 19 and the body portion 18, an annular space 22 is formed in which the container opening portion 3 is fitted. In an outer peripheral portion of the upper surface of the annular horizontal wall portion 20, an upwardly protruding annular projecting portion 17 is formed. In an upper inner wall surface of the cylindrical main fitting wall portion 19, formed is an annular fitting recess portion 23 annularly extending in the circumferential direction.

The annular wall portion 10 extends integrally from the entire areas in the circumferential direction of the lower inner wall surface of the cylindrical main fitting wall portion 19, toward a radial center and diagonally upward. The annular wall portion 10 has a truncated cone shape. By the annular wall portion 10 and the inner wall surface of the cylindrical main fitting wall portion 19, a space 24 with an open top is formed. The annular wall portion 10 has the ejection hole 25, which has a substantially circular shape, opened in the radially central portion thereof. The ejection hole 25 communicates with the interior of the container opening portion 3. Around the ejection hole 25, the annular valve seat 26 is formed. The annular valve seat 26 is formed on an inverted cone shaped surface 28. At one location in the annular valve seat 26 (inverted cone shaped surface 28) of the annular wall portion 10, a circulation groove 27 is formed in the radial direction. The circulation groove 27 is formed in a position on the opposite side from the hinge 6 side. The circulation groove 27 is formed with a substantially U-shaped cross section.

The annular horizontal wall portion 20 has an outer diameter smaller than an outer diameter of the body portion 18. On an outer wall surface of the annular horizontal wall portion 20, an annularly extending ridged locking portion 31 is formed in the circumferential direction. On the outer wall surface of the annular horizontal wall portion 20, the lid member 5 is fitted. From a lower surface of the annular horizontal wall portion 20, a cylindrical sub-fitting wall portion 32 descends concentrically in the annular space 22 between the body portion 18 and the cylindrical main fitting wall portion 19. In an annular space between the cylindrical sub-fitting wall portion 32 and the body portion 18, a plurality of reinforcing ribs 33 is formed at intervals in the circumferential direction. In the present embodiment, the reinforcing ribs 33 are formed at eight locations. The formation of the plurality of reinforcing ribs 33 makes it possible to maintain the rigidity of the cylindrical sub-fitting wall portion 32. The annular space is provided between the cylindrical sub-fitting wall portion 32 and the body portion 18 because if the annular space were not provided and the cylindrical sub-fitting wall portion 32 were to be integrally provided from the inner wall surface of the body portion 18, the cylindrical sub-fitting wall portion 32 would be thick, causing the problem of shrinkage and the like.

Figure 4:
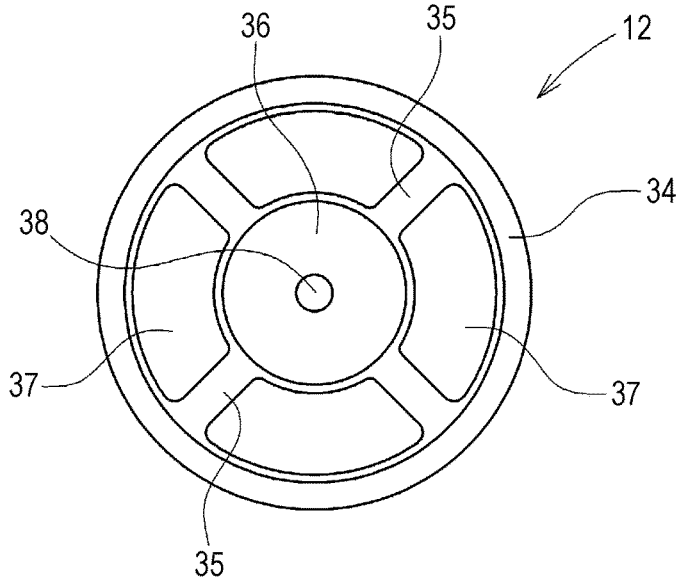
FIG. 4(*a*) is a plan view of a check valve in the configuration of the cap of FIG. 1.
Figure 4:
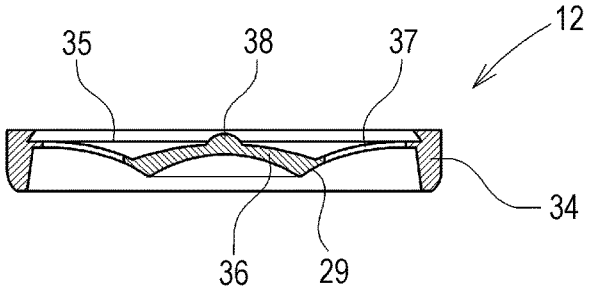
Figure 4:
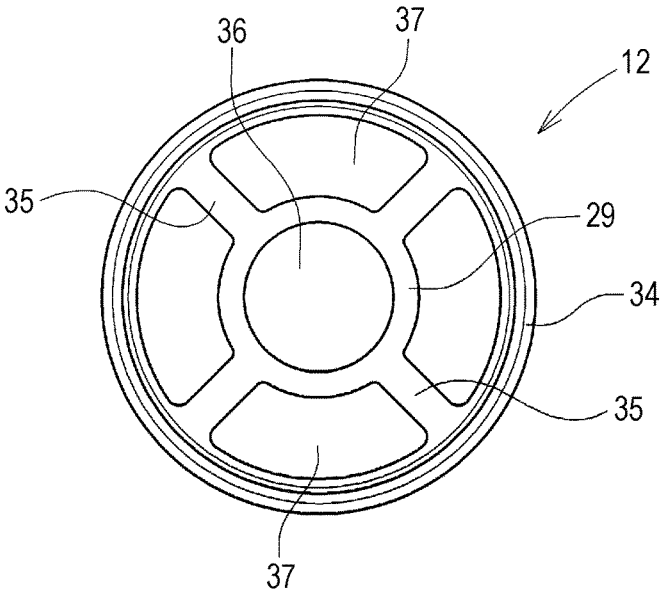

As illustrated in FIG. 1 and FIG. 4, the check valve 12 is configured from a cylindrical support portion 34, a plurality of elastic pieces 35, the valve portion 36, and a plurality of circulation holes 37. The cylindrical support portion 34 abuts on the inner wall surface of the cylindrical main fitting wall portion 19 of the main cap member 11. The plurality of elastic pieces 35 extend integrally from the inner wall surface of the cylindrical support portion 34 toward radial center. The valve portion 36 is integrally connected to the distal end portion of each of the elastic pieces 35, and opens and closes the ejection hole 25. The plurality of circulation holes 37 are provided between the respective elastic pieces 35. Through the circulation holes 37, the content from the ejection hole 25 is circulated.

The elastic pieces 35 extend from the upper inner wall surface of the cylindrical support portion 34 toward the radial center and diagonally downward, while slightly curving. In the present embodiment, the elastic pieces 35 are formed at four locations at a 90° pitch in the circumferential direction. Between the elastic pieces 35, the circulation holes 37 are formed at four locations at a 90° pitch. The distal end portion of each of the elastic pieces 35 is integrally connected to the upper edge of the outer peripheral portion of the valve portion 36. The valve portion 36 has a dome shape. Specifically, the valve portion 36 has a circular shape as viewed in plan, and includes an upwardly protruding curved wall portion. The outer peripheral portion of the valve portion 36 is formed with an inverted cone shaped surface 29 so as to be seated on the annular valve seat 26 (inverted cone shaped surface 28). From the upper surface of the valve portion 36, a spherical protruding portion 38 rises.

Figure 5:
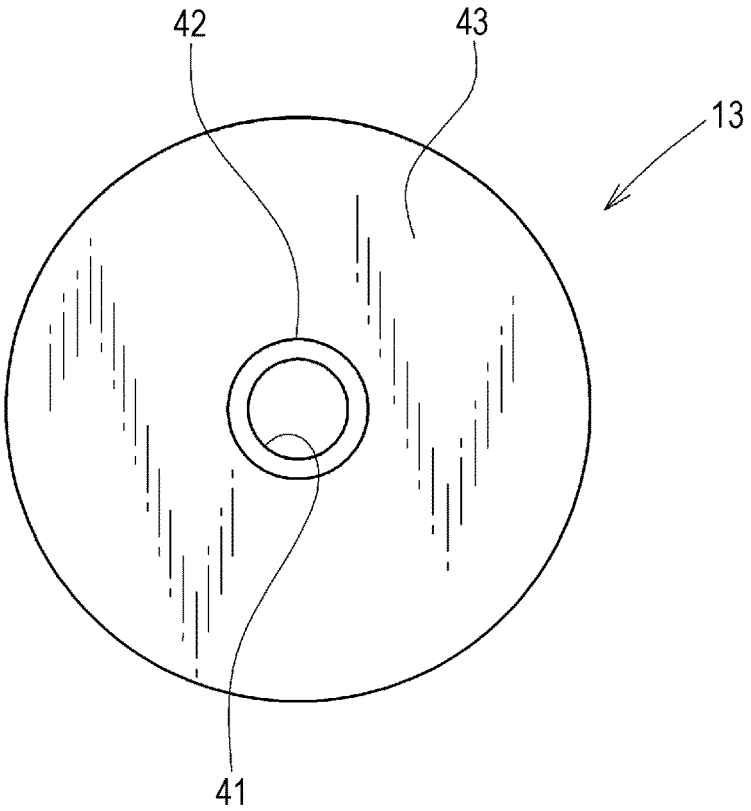
FIG. 5(*a*) is a plan view of an inner plug in the configuration of the cap of FIG. 1.
Figure 5:
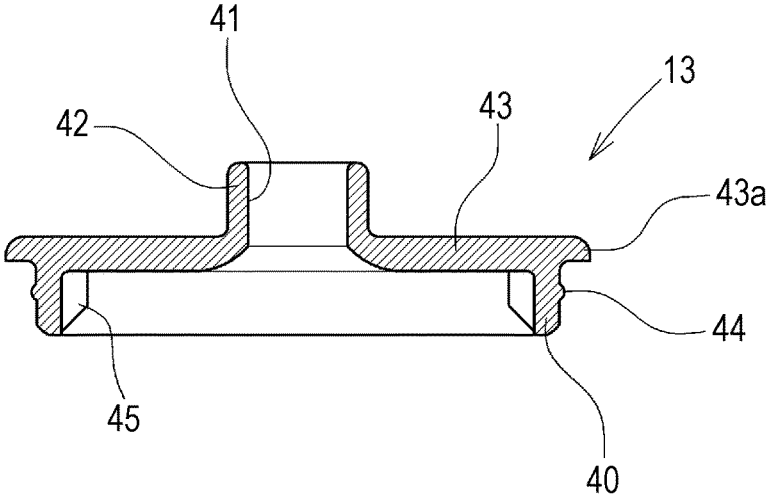

As illustrated in FIG. 1 and FIG. 5, the inner plug 13 is disposed over the check valve 12. The inner plug 13 is configured from a cylindrical support portion 40, a cylindrical guide portion 42, and an annular horizontal wall portion 43. The cylindrical support portion 40 is fitted on the cylindrical main fitting wall portion 19 of the main cap member 11. The cylindrical guide portion 42 is concentrically disposed on the inside of the cylindrical support portion 40, and includes an ejection passageway 41 therein. The annular horizontal wall portion 43 integrally connects the upper end of the cylindrical support portion 40 and the lower end of the cylindrical guide portion 42. The annular horizontal wall portion 43 is formed with an annular flange portion 43*a* which protrudes in the radial direction from the outer peripheral surface of the cylindrical support portion 40. Between the lower wall surface of the annular horizontal wall portion 43 and the inner wall surface of the cylindrical support portion 40, a plurality of reinforcing ribs 45 is formed at intervals in the circumferential direction. The cylindrical support portion 40 is disposed over the cylindrical support portion 34 of the check valve 12. On the outer wall surface of the cylindrical support portion 40, an annular ridge portion 44 is formed extending in the circumferential direction. The peripheral wall portion of the cylindrical support portion 40 of the inner plug 13 and the peripheral wall portion of the cylindrical support portion 34 of the check valve 12 have substantially the same thickness.

As illustrated in FIG. 1 and FIG. 2, the lid member 5 is integrally connected to the body portion 18 of the main cap member 11 via the hinge 6. The lid member 5 is configured from a cylindrical body portion 50 and a top portion 51. The cylindrical body portion 50 is connected to the outer wall surface of the body portion 18 of the main cap member 11 via the hinge 6. The top portion 51 is integrally connected to the entire areas in the circumferential direction of the upper end of the body portion 50. From the radially central portion of the top portion 51, a cylindrical close contact portion 52 descends. The cylindrical close contact portion 52 is closely fitted in the upper end of the cylindrical guide portion 42 of the inner plug 13 of the cap body 4. Between the body portion 50 and the cylindrical close contact portion 52 of the top portion 51, a cylindrical scattering suppression portion 55 descends. On the lower inner wall surface of the body portion 50, formed is a ridged locking portion 53 annularly extending in the circumferential direction. On the upper outer wall surface of the body portion 50 on the opposite side from the hinge 6, a holding portion 54 to be held by the user protrudes outward in a predetermined range in the circumferential direction.

A method for assembling the cap 2 and attaching the cap 2 to the container opening portion 3 will be described.

First, the check valve 12 is installed on the upper surface of the annular wall portion 10 of the main cap member 11 from above. Specifically, the check valve 12 is disposed on the upper surface of the annular wall portion 10 in such a way that the outer wall surface of the cylindrical support portion 34 of the check valve 12 lies along the inner wall surface of the cylindrical main fitting wall portion 19 of the main cap member 11. That is, the check valve 12 is installed from above into the space 24 with an open top enclosed by the annular wall portion 10 and the inner wall surface of the cylindrical main fitting wall portion 19.

Then, the inner plug 13 is disposed in an opening portion 19*a* within the cylindrical main fitting wall portion 19 of the main cap member 11. That is, the inner plug 13 is disposed such that the outer wall surface of the cylindrical support portion 40 of the inner plug 13 lies along the inner wall surface of the cylindrical main fitting wall portion 19 of the main cap member 11. The inner plug 13 is installed so as to press in the check valve 12. In this way, the annular ridge portion 44 provided on the outer wall surface of the cylindrical support portion 40 of the inner plug 13 is fitted in the annular fitting recess portion 23 provided in the inner wall surface of the cylindrical main fitting wall portion 19 of the main cap member 11. Also, the annular flange portion 43*a* of the inner plug 13 abuts on the upper surface of the annular horizontal wall portion 20. In this way, the inner plug 13 is installed. As a result, the outer peripheral portion (inverted cone shaped surface 29) of the valve portion 36 of the check valve 12 closely contacts the annular valve seat 26 (inverted cone shaped surface 28) around the ejection hole 25 of the annular wall portion 10. In this case, the lower end (outer peripheral portion) of the valve portion 36 of the check valve 12 is positioned higher than the position before installation. Accordingly, due to the downward urging force (recovery force) of each of the curved elastic pieces 35, the outer peripheral portion (inverted cone shaped surface 29) of the valve portion 36 of the check valve 12 closely contacts the annular valve seat 26 (inverted cone shaped surface 28) around the ejection hole 25 of the annular wall portion 10 so as to press the same. Immediately above the valve portion 36 (ejection hole 25) of the check valve 12, the cylindrical guide portion 42 of the inner plug 13 is positioned. Further, at an interval in the radial direction from the outer peripheral surface of the annular flange portion 43*a* of the inner plug 13, the annular projecting portion 17 provided on the annular horizontal wall portion 20 of the main cap member 11 is positioned. In this way, the assembly of the cap body 4 is completed.

Then, the lid member 5 is capped over the cap body 4 by bending the hinge 6 so that the lid member 5 covers the cap body 4 from above. As a result, the ridged locking portion 53 provided on the body portion 50 of the lid member 5 becomes engaged across the ridged locking portion 31 provided on the annular horizontal wall portion 20 of the main cap member 11. Also, the cylindrical close contact portion 52 provided on the top portion 51 of the lid member 5 is closely fitted in the upper end of the cylindrical guide portion 42 of the inner plug 13 of the cap body 4.

Then, the cap 2 is attached to the container opening portion 3 by capping by inserting the container opening portion 3 into the annular space 22 between the cylindrical main fitting wall portion 19 and the body portion 18 of the cap body 4. As a result, the inner wall surface of the cylindrical sub-fitting wall portion 32 descending from the annular horizontal wall portion 20 of the main cap member 11 into the annular space 22, and the outer wall surface of the large diameter opening portion 60 of the container opening portion 3 closely contact each other. Also, the outer wall surface of the cylindrical main fitting wall portion 19 of the main cap member 11, and the inner wall surface of the small diameter opening portion 61 of the container opening portion 3 closely contact each other. Further, the maximum diameter opening portion 62 of the container opening portion 3 moves across the ridged locking portion 21 provided on the lower inner wall surface of the body portion 18 of the main cap member 11, whereby one is disposed over the other in the vertical direction (with the maximum diameter opening portion 62 being disposed over the ridged locking portion 21). In this way, the maximum diameter opening portion 62 and the ridged locking portion 21 are engaged with each other. The maximum diameter opening portion 62 of the container opening portion 3 also closely contacts the inner wall surface of the body portion 18 of the main cap member 11. As a result, the reduced diameter opening portion 63 and the extended diameter opening portion 64 of the container opening portion 3 are pressed from below and thereby respectively elastically deformed. Due to the recovery force of each of the reduced diameter opening portion 63 and the extended diameter opening portion 64, the pressing force from the inner wall surface of the small diameter opening portion 61 of the container opening portion 3 toward the outer wall surface of the cylindrical main fitting wall portion 19 of the cap 2 is increased.

During capping, the close contact portion 16 (seal portion) between the outer wall surface of the cylindrical main fitting wall portion 19 of the main cap member 11 and the inner wall surface of the small diameter opening portion 61 of the container opening portion 3 is positioned higher than a connecting portion 15 between the annular wall portion 10 and the cylindrical main fitting wall portion 19. In addition, the annular wall portion 10 of the main cap member 11 extends toward the radial center and diagonally upward. Accordingly, when the container opening portion 3 is inserted into the annular space 22 of the main cap member 11, inward elastic deformation of the cylindrical main fitting wall portion 19 can be permitted compared with a configuration in which the annular wall portion 10 extends in the horizontal direction. Thus, the container opening portion 3 can be smoothly inserted into the annular space 22 without resistance. After insertion, the outward recovery force of the cylindrical main fitting wall portion 19 can be increased by the annular wall portion 10. Accordingly, the sealing between the outer wall surface of the cylindrical main fitting wall portion 19 of the main cap member 11 and the inner wall surface of the small diameter opening portion 61 of the container opening portion 3 can be further improved. In this way, the attachment of the cap 2 to the container opening portion 3 by capping is completed.

The operation of the cap 2 according to the embodiment of the present invention will be described.

When the content is used, first the lid member 5 is opened to externally expose the inner plug 13 of the cap body 4.

Then, the container 1 is inclined and placed in an ejecting state where the ejection passageway 41 of the inner plug 13 faces downward, and the body portion 7 of the container body 1*a* is squeezed to apply internal pressure to the container body 1*a*. In this way, the internal pressure of the container body 1*a* acts on the entire area of the lower wall surface of the valve portion 36 of the check valve 12. As a result, the elastic pieces 35 of the check valve 12 are elastically deformed and bent, whereby the outer peripheral portion (inverted cone shaped surface 29) of the valve portion 36 is detached from the annular valve seat 26 (inverted cone shaped surface 28) around the ejection hole 25 of the annular wall portion 10. Consequently, the ejection hole 25 of the annular wall portion 10 is opened, and an appropriate amount of the content is ejected outwardly from within the container opening portion 3, via the ejection hole 25, the circulation holes 37 of the check valve 12, and the ejection passageway 41 of the inner plug 13.

Thereafter, when the squeezing of the body portion 7 of the container body 1*a* is stopped, the internal pressure to the container body 1*a* is released, and the elastic pieces 35 of the check valve 12 recover. The outer peripheral portion (inverted cone shaped surface 29) of the valve portion 36 is seated on the annular valve seat 26 (inverted cone shaped surface 28) around the ejection hole 25 of the annular wall portion 10, and the ejection hole 25 of the annular wall portion 10 is closed by the valve portion 36. In this case, the content that was not ejected outwardly from the ejection passageway 41 of the inner plug 13 returns back into the container body 1*a* via the circulation groove 27. Thereafter, the pressing force from the valve portion 26 to the annular valve seat 26 increases. Because the valve portion 36 has elasticity, the opening area of the circulation groove 27 decreases. Finally, the content blocks the opening of the circulation groove 27 by surface tension, the opening being very small. Accordingly, the interior of the container body 1*a* can be maintained in a hermetically sealed state. Thus, while the content in the cap body 4 that was not ejected is returned into the container 1, the interior of the container 1 can be quickly hermetically sealed immediately after use, without the user manually operating the cap 2, and the entry of air into the interior of the container 1 can be suppressed.

Next, the hinge 6 is bent and the lid member 5 is moved to cover the cap body 4 from above. In this way, the ridged locking portion 53 provided on the body portion 50 of the lid member 5 becomes engaged so as to move across the ridged locking portion 31 provided on the annular horizontal wall portion 20 of the cap body 4 (main cap member 11). Also, the cylindrical close contact portion 52 provided on the top portion 51 of the lid member 5 is closely fitted in the upper end of the cylindrical guide portion 42 of the inner plug 13 of the cap body 4.

As the lid member 5 caps the cap body 4, the entry of foreign matter into the cap body 4 (between the inner plug 13 and the check valve 12 and annular wall portion 10) is suppressed, and the interior of the container 1 is doubly hermetically sealed. In addition, because the interior of the cap body 4 is hermetically sealed by the lid member 5, any of the content that may have slightly remained in the space 24 over the annular wall portion 10 does not become oxidized.

As described above, in the embodiment of the present invention, when the cap 2 is capped on the container opening portion 3 of the container body 1*a*, the inner wall surface of the cylindrical sub-fitting wall portion 32 of the main cap member 11 and the outer wall surface of the large diameter opening portion 60 of the container opening portion 3 closely contact each other. Also, the outer wall surface of the cylindrical main fitting wall portion 19 of the main cap member 11 and the inner wall surface of the small diameter opening portion 61 of the container opening portion 3 closely contact each other. Further, the maximum diameter opening portion 62 of the container opening portion 3 becomes engaged by moving across the ridged locking portion 21 provided on the lower inner wall surface of the body portion 18 of the main cap member 11. The maximum diameter opening portion 62 of the container opening portion 3 also closely contacts the inner wall surface of the body portion 18 of the main cap member 11. As a result, the reduced diameter opening portion 63 and the extended diameter opening portion 64 of the container opening portion 3 are respectively elastically deformed by being pressed from below. Their recovery force increases the pressing force from the inner wall surface of the small diameter opening portion 61 of the container opening portion 3 toward the outer wall surface of the cylindrical main fitting wall portion 19 of the cap 2. In this way, the sealing between the outer wall surface of the cylindrical main fitting wall portion 19 of the cap 2 and the inner wall surface of the small diameter opening portion 61 of the container opening portion 3 can be improved.

In addition, in the embodiment of the present invention, the main cap member 11 is provided with the annular wall portion 10. The annular wall portion 10 extends integrally from the inner wall surface of the cylindrical main fitting wall portion 19 toward the radial center and diagonally upward, and includes the ejection hole 25 in the radially central portion. The close contact portion 16 between the outer wall surface of the cylindrical main fitting wall portion 19 and the inner wall surface of the small diameter opening portion 61 of the container opening portion 3 is positioned higher than the connecting portion 15 between the cylindrical main fitting wall portion 19 and the annular wall portion 10. In this way, when the container opening portion 3 is inserted into the annular space 22 of the main cap member 11, inward elastic deformation of the cylindrical main fitting wall portion 19 can be permitted compared with a configuration in which the annular wall portion 10 extends in the horizontal direction. Accordingly, the container opening portion 3 can be smoothly inserted into the annular space 22 without resistance. After insertion, the outward recovery force of the cylindrical main fitting wall portion 19 can be increased by the annular wall portion 10. Accordingly, the sealing between the outer wall surface of the cylindrical main fitting wall portion 19 of the main cap member 11 and the inner wall surface of the small diameter opening portion 61 of the container opening portion 3 can be further improved.

DESCRIPTION OF REFERENCE SIGNS

1 Container
1*a* Container body
2 Cap
3 Container opening portion
10 Annular wall portion
11 Main cap member
12 Check valve
15 Connecting portion
16 Close contact portion
18 Body portion
19 Cylindrical main fitting wall portion
21 Ridged locking portion
22 Annular space
25 Ejection hole
26 Annular valve seat
32 Cylindrical sub-fitting wall portion
36 Valve portion
60 Large diameter opening portion
61 Small diameter opening portion
62 Maximum diameter opening portion
63 Reduced diameter opening portion
64 Extended diameter opening portion

The invention claimed is:

1. A container comprising:

a container body including a container opening portion; and a cap attached to the container opening portion by capping, the container opening portion including:

a large diameter opening portion disposed at an upper end of the container opening portion, and a small diameter opening portion disposed under the large diameter opening portion and having an outer diameter smaller than an outer diameter of the large diameter opening portion, the cap including:

a body portion, a tubular main fitting wall portion disposed inside the body portion, an annular space which is provided between the body portion and the main fitting wall portion, and in which the container opening portion is fitted, a tubular sub-fitting wall portion formed in the annular space, an annular wall portion which integrally extends from an inner wall surface of the main fitting wall portion toward a radial center and diagonally upward, and which includes an ejection hole in a radially central portion, and a check valve which covers the annular wall portion from an upper side of the annular wall portion and which is configured to open and close the ejection hole as a valve portion is detached from or seated on an annular valve seat around the ejection hole wherein when the cap is capped on the container opening portion, an inner wall surface of the sub-fitting wall portion of the cap and an outer wall surface of the large diameter opening portion of the container opening portion closely contact each other, and an outer wall surface of the main fitting wall portion of the cap and an inner wall surface of the small diameter opening portion of the container opening portion closely contact each other at a close contact portion, and the check valve is positioned at the same level as the close contact portion in a horizontal direction.

2. The container according to claim 1, wherein the container opening portion includes:

an extended diameter opening portion which gradually extends in diameter continuously downward from the small diameter opening portion, and a maximum diameter opening portion extending downward in an axial direction continuously from the extended diameter opening portion, and having a diameter greater than a diameter of the large diameter opening portion, wherein when the cap is capped on the container opening portion, the maximum diameter opening portion of the container opening portion becomes engaged by moving across a ridged locking portion provided on a lower inner wall surface of the body portion of the cap, and the maximum diameter opening portion closely contacts the lower inner wall surface of the body portion, thereby causes the extended diameter opening portion to become elastically deformed by being pressed from below.

3. The container according to claim 1, wherein the cap further includes a plurality of reinforce ribs in the annular space between the body portion and the sub-fitting wall portion, the plurality of reinforce ribs being formed at intervals in a circumference direction of the cap.

4. The container according to claim 1, wherein the cap further includes an annular horizontal wall portion connecting an upper end of the main fitting wall portion and an upper end of the sub-fitting wall portion, the annular horizontal wall portion being in direct contact with a top end of the large diameter opening portion of the container opening portion.

5. The container according to claim 1, wherein a connecting portion between the inner wall surface of the main fitting wall portion and the annular wall portion is positioned lower than an upper end of the main fitting wall portion, and the close contact portion is positioned higher than the connecting portion and lower than the upper end of the main fitting wall portion.

6. A cap attached to a container opening portion of a container having a container body by capping, the cap comprising:

a body portion;

a tubular main fitting wall portion disposed inside the body portion, an outer wall surface of the main fitting wall portion closely contacting an inner wall surface of a small diameter opening portion of the container opening portion at a close contact portion;

an annular space which is disposed between the body portion and the main fitting wall portion, and in which the container opening portion is fitted;

a tubular sub-fitting wall portion which is formed in the annular space, the sub-fitting wall portion closely contacting an outer wall surface of an upper end of the container opening portion;

an annular wall portion which integrally extends from an inner wall surface of the main fitting wall portion toward a radial center and diagonally upward, and which includes an ejection hole in a radially central portion; and a check valve which covers the annular wall portion from an upper side of the annular wall portion and which is configured to open and close the ejection hole as a valve portion is detached from or seated on an annular valve seat around the ejection hole, wherein the check valve is positioned at the same level as the close contact portion in a horizontal direction.

7. The cap according to claim 6, wherein the close contact portion is positioned higher than a connecting portion between the main fitting wall portion and the annular wall portion.

8. The cap according to claim 6, wherein the cap further includes a plurality of reinforce ribs in the annular space between the body portion and the sub-fitting wall portion, the plurality of reinforce ribs being formed at intervals in a circumference direction of the cap.

9. The cap according to claim 6, wherein a connecting portion between the inner wall surface of the main fitting wall portion and the annular wall portion is positioned lower than an upper end of the main fitting wall portion, and the close contact portion is positioned higher than the connecting portion and lower than the upper end of the main fitting wall portion.

* * * * *